US009334874B2

(12) United States Patent
Xia et al.

(10) Patent No.: US 9,334,874 B2
(45) Date of Patent: May 10, 2016

(54) BLADE OF AXIAL FLOW IMPELLER AND AXIAL FLOW IMPELLER

(71) Applicants: Jiliang Xia, Pori (FI); Niclas Tylli, Veikkola (FI); Tuomas Hirsi, Helsinki (FI)

(72) Inventors: Jiliang Xia, Pori (FI); Niclas Tylli, Veikkola (FI); Tuomas Hirsi, Helsinki (FI)

(73) Assignee: Outotec (Finland) Oy, Espoo (FI)

( * ) Notice: Subject to any disclaimer, the term of this patent is extended or adjusted under 35 U.S.C. 154(b) by 0 days.

(21) Appl. No.: 14/378,628

(22) PCT Filed: Feb. 18, 2013

(86) PCT No.: PCT/FI2013/050185
§ 371 (c)(1),
(2) Date: Aug. 13, 2014

(87) PCT Pub. No.: WO2013/124539
PCT Pub. Date: Aug. 29, 2013

(65) Prior Publication Data

US 2015/0240832 A1 Aug. 27, 2015

(30) Foreign Application Priority Data

Feb. 20, 2012 (FI) ..... 20125193

(51) Int. Cl.
*B01F 7/22* (2006.01)
*F04D 29/18* (2006.01)
(Continued)

(52) U.S. Cl.
CPC ..... *F04D 29/181* (2013.01); *B01F 7/00341* (2013.01); *B01F 7/00375* (2013.01); *B01F 7/22* (2013.01); *F04D 3/00* (2013.01);
(Continued)

(58) Field of Classification Search
CPC .... B01F 7/06; B01F 7/00275; B01F 7/00383; B01F 7/00375; B01F 7/00366; B01F 7/00341; B01F 7/22
USPC ..... 366/270, 330.1–330.7; 416/237
See application file for complete search history.

(56) References Cited

U.S. PATENT DOCUMENTS 1,838,453 A * 12/1931 Rosen ..... B64C 11/18 416/237
2,148,555 A * 2/1939 Hicks ..... B64C 11/16 416/202
(Continued)

FOREIGN PATENT DOCUMENTS

CN 1058355 A 2/1992
CN 2263228 Y 9/1997
(Continued)

OTHER PUBLICATIONS

International Search Report for PCT/F12013/050185, completed May 26, 2013, mailed May 29, 2013, 3 pages.
(Continued)

*Primary Examiner* — Charles Cooley
(74) *Attorney, Agent, or Firm* — Chernoff, Vilhauer, McClung & Stenzel, LLP

(57) ABSTRACT

The invention relates to dimensioning rules for a blade of an axial flow impeller. The dimensioning rules relate to: (i) the lengthwise dimension from the axis of rotation of the impeller to the tip of the blade; (ii) the widthwise dimension of the blade perpendicularly to the lengthwise direction; and (iii) respective angles for a plurality of folds of the blade. The invention also relates to an axial flow impeller having such blades.

4 Claims, 4 Drawing Sheets

(51) Int. Cl.
*B01F 7/00* (2006.01)
*F04D 3/00* (2006.01)

(52) U.S. Cl.
CPC . *B01F2215/0409* (2013.01); *B01F 2215/0422* (2013.01); *B01F 2215/0431* (2013.01)

(56) References Cited

U.S. PATENT DOCUMENTS 3,030,083 A * 4/1962 Stiffler ..... B01F 7/00475 366/316
3,147,958 A * 9/1964 Stiffler ..... A47J 3/0722 241/98
4,177,012 A * 12/1979 Charles ..... F04D 29/382 416/132 A
4,479,721 A * 10/1984 Rieger ..... B01F 7/00158 366/147
4,519,715 A * 5/1985 Golobic ..... B01F 7/00341 366/343
5,326,226 A * 7/1994 Wyczalkowski .... B01F 7/00341 29/889.3
5,813,837 A 9/1998 Yamamoto et al.
5,988,604 A * 11/1999 McWhirter ..... B01F 3/0478 261/119.1
6,877,959 B2 * 4/2005 McWhirter ..... F04D 29/384 366/265
7,114,844 B2 * 10/2006 Weetman ..... B01F 3/0478 366/328.3
7,296,925 B2 * 11/2007 Himmelsbach ..... B01F 7/00275 366/330.3
7,374,333 B2 * 5/2008 Eisenkraetzer ..... B01F 7/00166 366/330.3
7,473,025 B1 * 1/2009 Howk ..... B01F 7/00341 29/889.7
8,220,986 B2 * 7/2012 Janz ..... B01F 7/001 366/330.1
9,138,698 B2 * 9/2015 Lilja ..... B01F 7/00341
2004/0228210 A1 * 11/2004 Himmelsbach ..... B01F 7/00275 366/330.3
2005/0243646 A1 * 11/2005 Eisenkraetzer ..... B01F 7/00166 366/330.3
2010/0124147 A1 * 5/2010 Janz ..... B01F 7/00341 366/343
2012/0039721 A1 * 2/2012 Lilja ..... B01F 7/00341 416/241 R
2014/0211585 A1 * 7/2014 Maxon ..... B01F 7/22 366/279
2015/0044057 A1 * 2/2015 Dinnison ..... B01F 7/00366 416/237
2015/0240832 A1 * 8/2015 Xia ..... F04D 29/181 416/243

FOREIGN PATENT DOCUMENTS

CN 201574972 U 9/2010
CN 102348498 A 2/2012
DE 2624991 C2 * 4/1985 ..... B01F 7/00341
DE 4401596 A1 * 7/1995 ..... B01F 7/00341
DE 69323004 T2 6/1999
EP 0469302 A1 2/1992
EP 0465636 B1 4/1995
KR 20040012627 A 2/2004
KR 100970137 B1 7/2010
WO 2010059572 A1 11/2005
WO 2008025975 A1 3/2008
WO 2010059572 A1 5/2010
WO 2010103172 A1 9/2010
WO WO 2013124539 A1 * 8/2013 ..... B01F 7/00375

OTHER PUBLICATIONS

Finnish Search Report for Finnish Patent Application No. 20125193 completed Dec. 11, 2012, 1 page.
State Intellectual Property Office of the P.R.C., Office Action issued in application 201380010088.9, Jun. 3, 2015, Beijing, China.
European Patent Office, Extended Search Report issued in application No. 13751453.5, Oct. 23, 2015, Munich, Germany.

* cited by examiner

BLADE OF AXIAL FLOW IMPELLER AND AXIAL FLOW IMPELLER

CROSS-REFERENCE TO RELATED APPLICATION

This is a national stage application filed under 35 USC 371 based on International Application No. PCT/FI2013/050185 filed Feb. 18, 2013, and claims priority under 35 USC 119 of Finnish Patent Application No. 20125193 filed Feb. 20, 2012.

FIELD OF THE INVENTION

The present invention relates to a blade of an axial flow impeller, and further to an axial flow impeller including said blades. Impellers are widely used in metallurgical and chemical processes in mixers and reactors for mixing, blending and agitating liquids and slurries, suspensions of solids and liquids. Axial flow impellers, also called hydrofoil impellers, produce an axial flow of the liquid.

BACKGROUND OF THE INVENTION

Axial flow impellers are known, e.g. from the following documents WO 2010/103172 A1, WO 2010/059572 A1 and EP 0465636 B1. A blade of an axial flow impeller is connectable to a central hub of the impeller. The impeller comprises two or more such blades. The blade is formed from substantially plate-type material. The blade includes a leading edge, a trailing edge, a tip, and a root attachable to the central hub of the impeller. A straight first bend extends along the blade in a first direction and divides the blade into a first profile portion located adjacent to the leading edge and a second profile portion. The first and the second profile portions meet at the first bend such that the first profile portion is angled at a first angle downwardly from the second profile portion. A straight second bend extends along the blade in a second direction which is different from said first direction and located apart from the first bend. The second bend divides the blade further into a third profile portion located adjacent to the trailing edge. The second and third profile portions meet at said second bend such that the third profile portion is angled at a second angle downwardly from the second profile portion. The second profile portion is angled at a third angle in relation to horizontal plane.

In the market there are some known types of axial flow impellers commercially available that perform with reasonably good performance.

However, there is still a need for an even better axial flow impeller with low energy consumption and which still provides high pumping capacity and pumping efficiency. In many metallurgical applications (e.g. gold processes and storage tanks), there is a need for an axial flow impeller with as high pumping capacity as possible per shaft power. For gold processes it is also crucial that the impeller region is as free of high energy dissipation zones as possible as these would act to destroy the carbon which is used to collect the gold.

Therefore, it is desirable to provide an efficient axial flow impeller which performs well to satisfy process requirements with less power consumption, less residence time, higher pumping efficiency and less weight.

An object of the present invention is to provide a blade for an axial flow impeller which provides the axial flow impeller with better performance characteristics than the existing axial flow impellers. The object on the invention is also to provide a blade and axial flow impeller having a low power consumption and low operational cost, high pumping capacity and pumping efficiency and great pumping mass flow rate per unit of energy consumption. Further, the object is also to provide blade shape and scaling rules for the blade of the axial flow impeller that enable scaling up and down.

SUMMARY OF THE INVENTION

A first aspect of the present invention is a blade of an axial flow impeller, said blade being connectable to a central hub of the impeller, the blade being formed from substantially plate-type material and having a leading edge, a trailing edge, a tip, a root attachable to the central hub of the impeller, a straight first bend extending along the blade in a first direction and dividing the blade into a first profile portion located adjacent to the leading edge and a second profile portion, the first and the second profile portions meeting at the first bend such that the first profile portion is angled at a first angle downwardly from the second profile portion, a straight second bend extending along the blade in a second direction which is different from said first direction and located apart from the first bend and dividing the blade further into a third profile portion located adjacent to the trailing edge, said second and third profile portions meeting at said second bend such that the third profile portion is angled at a second angle downwardly from the second profile portion, the second profile portion being angled at a third angle in relation to horizontal plane. In plan view, the blade has the general form of an enveloping rectangle with tapering cut-outs at at least root-side corners of the rectangle, said rectangle having a length which is the lengthwise dimension from the axis of rotation of the impeller to the tip of the blade, and a width which is the widthwise dimension of the blade perpendicularly to the lengthwise direction, the enveloping rectangle having inner corners adjacent to the root and outer corners adjacent to the tip.

According to the invention the contour of the blade is defined by the proportional dimensions of the tapering cut-outs from the enveloping rectangle. The cutouts comprise

- a first cut-out which is adjacent the root and a first inner corner of the rectangle at the side of the leading edge, the first cut-out having a form of a right triangle with the lengthwise cathetus having a dimension A=0.2R, a widthwise cathetus having a dimension $B=0.2W_b$, and a hypotenuse which forms a first cut-out edge of the blade extending from the hub to the leading edge,
- a second cut-out which is adjacent to the root and a second inner corner of the rectangle at the side of the trailing edge, the second cut-out having a form of a right triangle with the lengthwise cathetus having a dimension C=0.2R, a widthwise cathetus having a dimension $D=0.2W_b$, and a hypotenuse which forms a second cut-out edge of the blade extending from the hub to the trailing edge,
- a third cut-out which is adjacent to the tip and a first outer corner of the rectangle at the side of the leading edge, the third cut-out having a form of a right triangle with the lengthwise cathetus having a dimension E=0.5R, a widthwise cathetus having a dimension F (0, 1 to 0 , 2) R F (0.1 to 0.2) R and a hypotenuse which forms a third cut-out edge of the blade extending from the leading edge to the tip, the third cutout edge connecting to the tip with a rounding having a radius of curvature $G=0.2W_b$, and
- a fourth cut-out which is adjacent to the tip and a second outer corner of the rectangle at the side of the trailing edge, the fourth cut-out having a form of a right triangle with the having a dimension H=0.25R, a having a dimension I=0.1R and forms a fourth cut-out edge of lengthwise cathetus widthwise cathetus a hypotenuse which the blade extending from the trailing edge to the tip, the fourth cut-out edge connecting to the tip with a rounding having a radius of curvature $G=0.2W_b$. The first bend intersects the lengthwise side of the enveloping rectangle at the meeting point of the first cut-out edge and the leading edge at the distance A=0.2R from the first inner corner, and the first bend intersects the widthwise side of the enveloping rectangle adjacent to the tip at the distance J=0.4R from the third corner. The second bend intersects the widthwise side of the enveloping rectangle adjacent to the root at a widthwise distance $K=0,1W_b$ from the first corner, and the second bend intersects the side of the enveloping rectangle adjacent to the tip at a widthwise distance I=0.1R from the fourth corner. The first angle is 6°±1°, the second angle is 8°±1° and the third angle is 19° to 25°.

A second aspect of the present invention is an axial flow impeller comprising a central hub adapted as connectable to a rotatable shaft having a central axis of rotation, and at least two blades having contour as mentioned above, the blades being attached to the hub and extending radially outwardly from the hub.

The advantage of the invention is that new impeller with optimized blade shape is easy to fabricate and scale up and down according to the proposed rules. The impeller is characterized of low power consumption, high pumping capacity and pumping efficiency, and great pumping mass flow rate per unit of energy consumption.

In an embodiment of the invention, the leading edge is chamfered or thinned.

In an embodiment of the invention, the trailing edge is chamfered or thinned.

In an embodiment of the invention, the impeller comprises at least three equally-spaced blades.

In an embodiment of the invention, the impeller comprises four or more equally-spaced blades.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1:
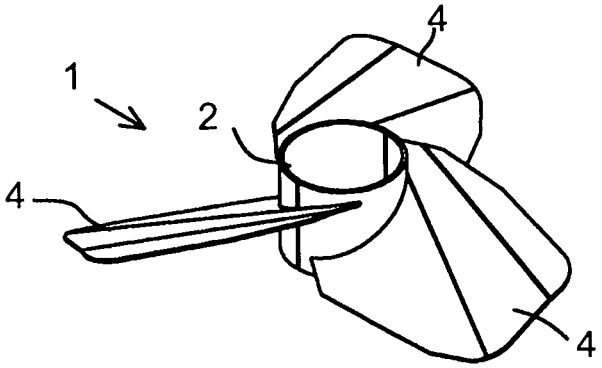
FIG. 1 is an axonometric view of an axial flow impeller according to one embodiment of the invention.
Figure 2:
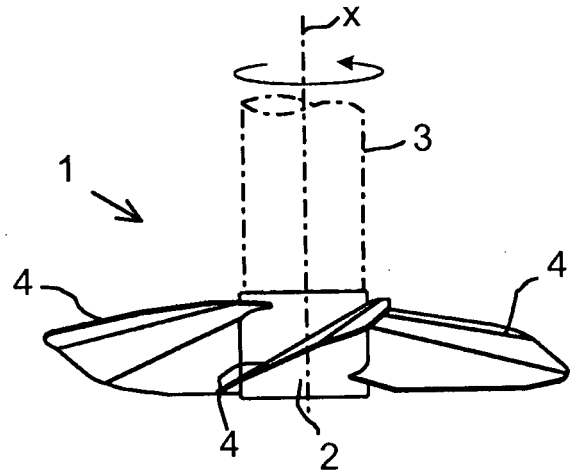
FIG. 2 is a side view of the impeller of FIG. 1.
Figure 3:
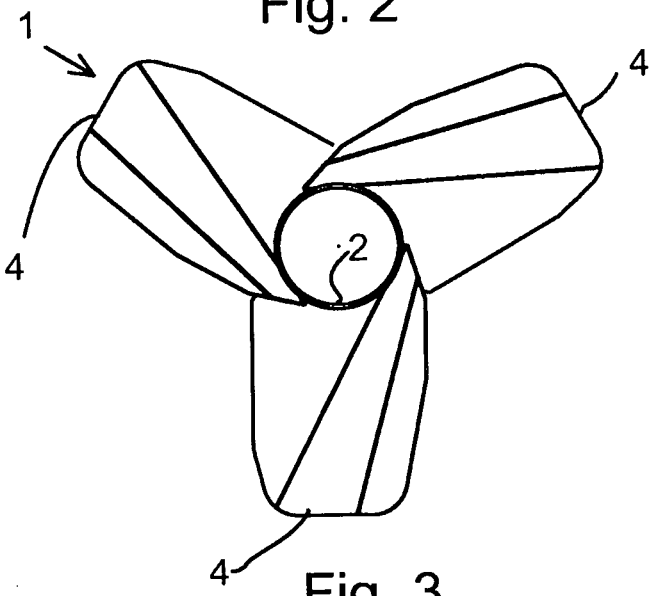
FIG. 3 is a plan view of the impeller of FIG. 1 seen from above.

FIGS. 1 to 3 show an axial flow impeller 1 having three equally-spaced blades 4 which are permanently or releasably connected to a central hub 2 or rotatable shaft 3. Although the shown embodiment has three blades, two, three, four or more blades 4 may be utilized in accordance with the present invention.

Figure 4:
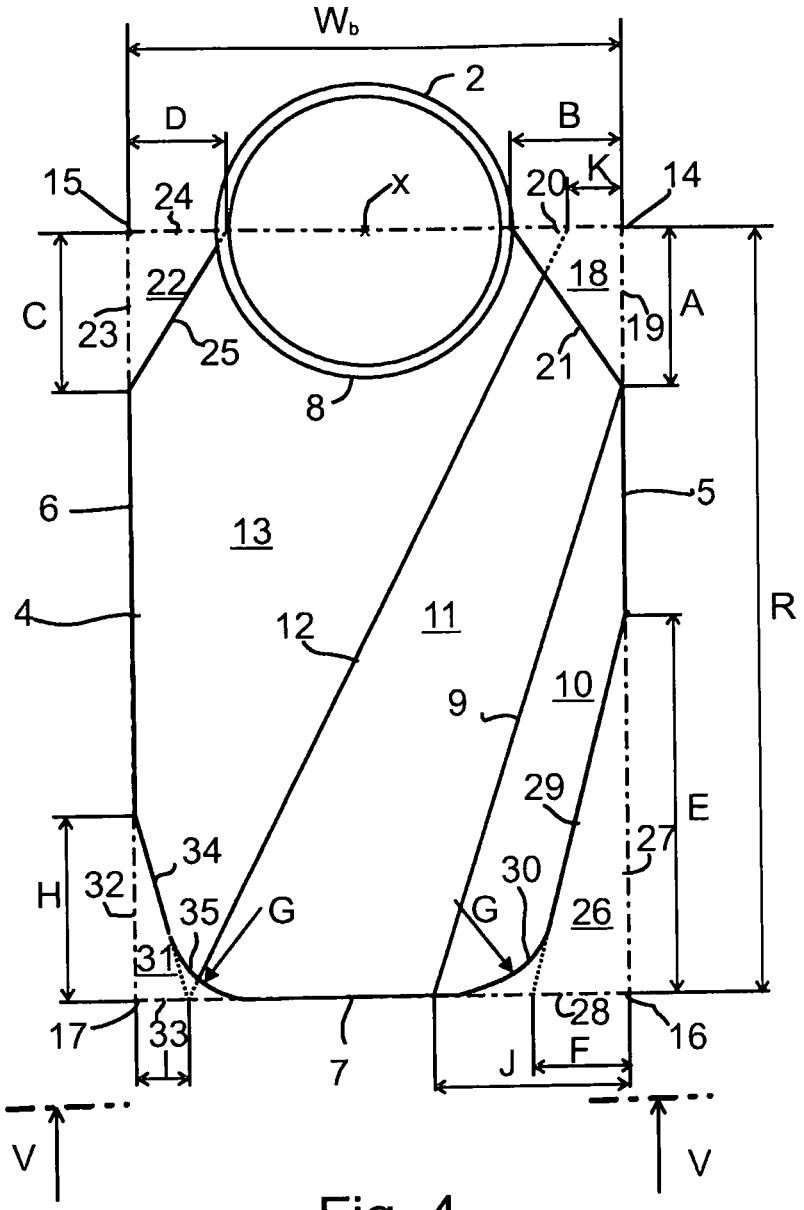
FIG. 4 is a plan view of a blade of an axial flow impeller according to one embodiment of the invention.
Figure 5:
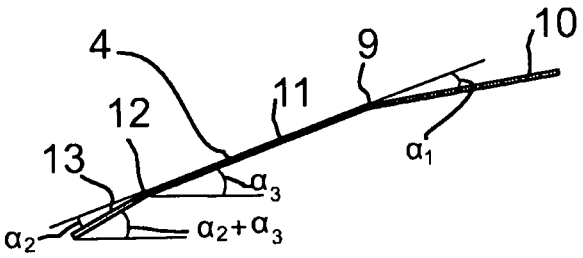
FIG. 5 is a side view V-V of the blade of Fig. IV.

FIGS. 4 and 5 show the contour of the blade 4 in more detail. The blade 4 is formed from substantially plate-type material which makes it easy and economical to manufacture. The blade 4 comprises a leading edge 5, a trailing edge 6, a tip 7 and a root 8 attachable to the central hub 2 of the impeller.

A straight first bend 9 extends along the blade 4 in a first direction and divides the blade into a first profile portion 10 located adjacent to the leading edge 5 and a second profile portion 11. The first and the second profile portions 10, 11 meet at the first bend 9 such that the first profile portion 10 is angled at a first angle $\alpha_1$ downwardly from the second profile portion 11, see also FIG. 5.

A straight second bend 12 extends along the blade 4 in a second direction which is different from said first direction of the first bend 9 and is located apart from the first bend 9 and divides the blade 4 further into a third profile portion 13 located adjacent to the trailing edge 6.

At the bends 9 and 12 the angles do not have to be obtuse angles as shown in FIG. 5. At the bends 9 and 12 the "angles" may also have a radius of curvature. This may be when the blade is a casting manufactured by casting.

The second and third profile portions 11, 13 meet at the second bend 12 such that the third profile portion 13 is angled at a second angle $\alpha_2$ downwardly from the second profile portion 11, the second profile portion 11 being angled at a third angle $\alpha_3$ in relation to horizontal plane, see FIG. 5.

In plan view, as shown in FIG. 4, the blade 4 has the general form of an enveloping rectangle R×Wb with tapering cut-outs at each corner of the rectangle. The rectangle has a length R which is the lengthwise dimension from the axis of rotation x of the impeller to the tip 7 of the blade 4, and a width $W_b$ which is the widthwise dimension of the blade perpendicularly to the lengthwise direction. The enveloping rectangle has inner corners 14, 15 adjacent to the root 8 and outer corners 16, 17 adjacent to the tip 7.

The contour of the blade 4 is defined by the proportional dimensions of the tapering cutouts 18, 22, 26, 31 from the enveloping rectangle. The cutouts comprise a first cut-out 18 which is adjacent the root 8 and a first inner corner 14 of the rectangle at the side of the leading edge 5. The first cut-out 18 has a form of a right triangle with the lengthwise cathetus 19 having a dimension, A=0.2R a widthwise cathetus 20 having a dimension B $0.2W_b$, and a hypotenuse which forms a first cut-out edge 21 of the blade extending from the root 8 to the leading edge 5

A second cut-out 22 is adjacent to the root 8 and a second inner corner 15 of the rectangle at the side of the trailing edge 6. The second cut-out 22 has a form of a right triangle with the lengthwise cathetus 23 having a dimension C=0.2R, a widthwise cathetus 24 having a dimension $D=0.2W_b$, and a hypotenuse which forms a second cut-out edge 25 of the blade extending from the root 8 to the trailing edge 6.

A third cut-out 26 is adjacent to the tip 7 and a first outer corner 16 of the rectangle at the side of the leading edge 5. The third cut-out 26 has a form of a right triangle with the lengthwise cathetus 27 having a dimension E=0.5R, a widthwise cathetus 28 having a dimension F=(0.1 to 0.2)R and a hypotenuse which forms a third cut-out edge 29 of the blade extending from the leading edge 5 to the tip 7. The third cut-out edge 29 connects to the tip 7 with a rounding 30 having a radius of curvature $G=0.2W_b$.

A fourth cut-out 31 is adjacent to the tip 7 and a second outer corner 17 of the rectangle at the side of the trailing edge 6. The fourth cut-out 31 has a form of a right triangle with the lengthwise cathetus 32 having a dimension H=0.25R, a widthwise cathetus 33 having a dimension I=0.1R and a hypotenuse which forms a fourth cut-out edge 34 of the blade extending from the trailing edge 6 to the tip 7. The fourth cutout edge 34 connects to the tip 7 with a rounding 35 having a radius of curvature curvature $G=0.2W_b$.

The first bend 9 intersects the lengthwise side of the enveloping rectangle at the meeting point of the first cut-out edge 21 and the leading edge 5 at the distance A=0.2R from the first inner corner 14. The first bend 9 intersects the widthwise side of the enveloping rectangle adjacent to the tip 7 at the distance J=0.4R from the third corner 17.

The second bend 12 intersects the widthwise side of the enveloping rectangle adjacent to the root 8 at a widthwise distance $K=0.1W_b$ from the first corner 1. The second bend 12 intersects the side of the enveloping rectangle adjacent to the tip 7 at a widthwise distance I=0.1R from the fourth corner 17.

With reference to FIG. 5, the first angle $\alpha_1$ is 6°±1°, the second angle $\alpha_2$ is 8°±1° and the third angle $\alpha_3$ is 19° to 25°. Thus the pitch angle ($\alpha_2+\alpha_3$) of the blade at the root joined to the hub can vary in a range of 27° to 33°, depending on the requirements of a practical application. A larger blade pitch angle provides a higher pumping capacity, but may result in greater power consumption. It is demonstrated below that the invented impeller can provide excellent mixing performance with very low power consumption and high pumping capacity and effectiveness with the above-mentioned rules for the blade configuration.

The three profiles 10, 11, 13 are flat sections. The blade is free of special curvatures and is made of flat sections joined along straight folds, and the cut-offs along the front and trailing edges are straight forward. Therefore, the blade 4 is easy to manufacture. Thus, the scaling of blade design is easy and simplified by just following the rules stated above.

Preferably, the front edge 5 and trailing edge may be chamfered with a shallow angle by a plane of the respective section, or they can be thinned and smoothened respective to the blade thickness. The chamfered or thinned front and trailing edges can further reduce the drag and improve efficiency.

Figure 6:
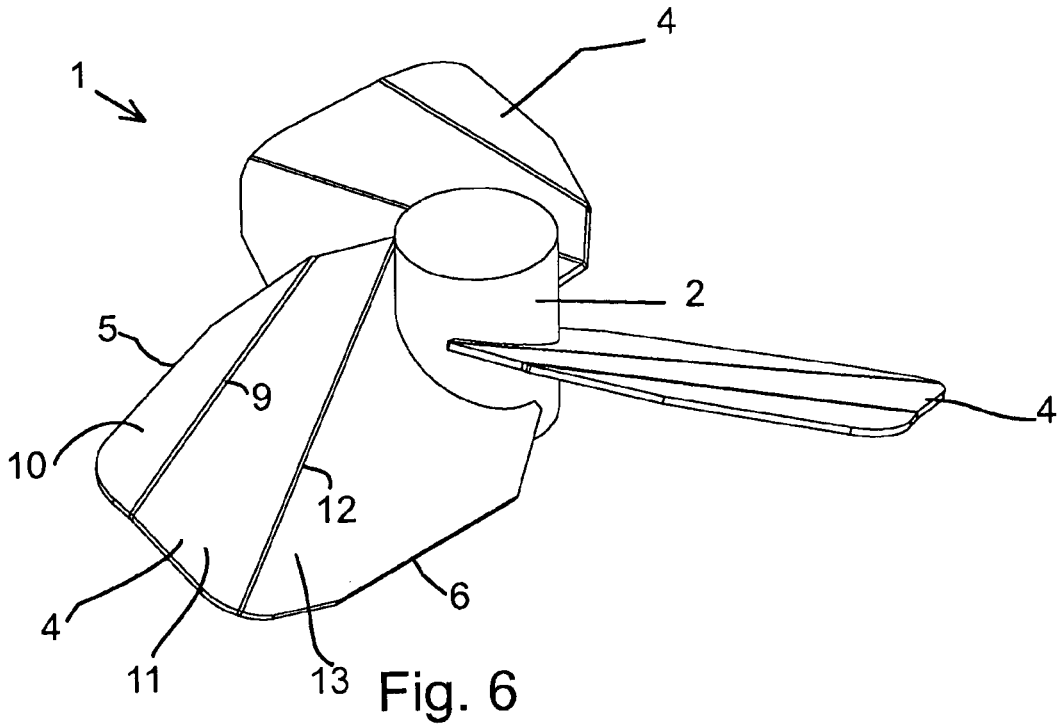
FIG. 6 shows a second embodiment of the axial flow impeller having blades designed according to the scaling rules of the invention.
Figure 7:
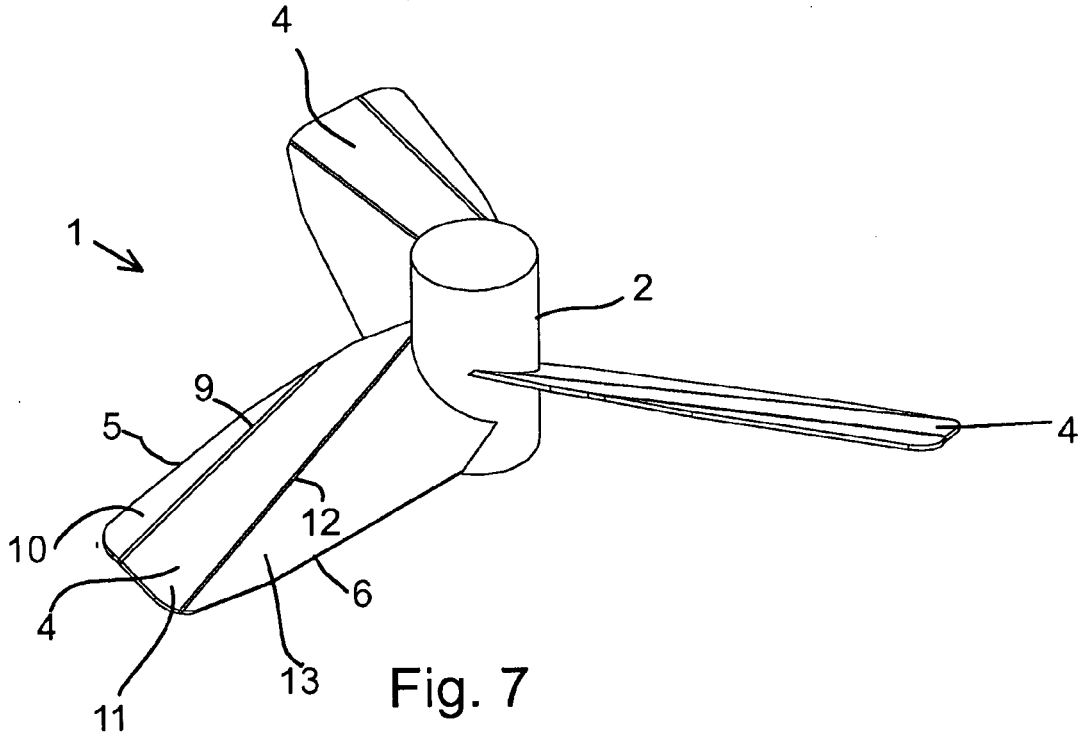
FIG. 7 shows a third embodiment of the axial flow impeller having blades designed according to the scaling rules of the invention.

FIGS. 6 and 7 shows two axial flow impellers 1 having blades 4 dimensioned according to above-stated rules of the invention. In FIG. 6 the blades 4 have a wide "fat" contour and in FIG. 7 the blades 4 have a narrow "slim" contour.

Although only few examples of the blade shape are shown herein, it should be understood that the invention allows a great number of blade shapes within the scope of the claims.

EXAMPLE

CFD modeling (CFD: Computational Fluid Dynamics) was used to simulate the fluid dynamics in an industrial scale reactor which was equipped with the axial flow impeller having the optimized blade shape of the invention dimensioned as described above. The simulation was made with the specifications listed in Table I. The cylindrical reactor is 8 m in diameter and 8 m in height. The bottom clearance is 3.2 m, which is equal to the diameter of impeller blade. Three blades impeller is taken into account.

TABLE I

| Specification of reactor | | |
|---|---|---|
| tank height, H | m | 8 |
| tank diameter, T | m | 8 |
| impeller diameter, D | m | 3.2 |
| impeller width, $W_b$ | m | 1 |
| blade number | | 3 |
| pitch angle $\alpha_2+\alpha_3$ (FIG. 5), | ° | 27-33 |
| impeller speed, N | rpm | 30 |
| impeller bottom clearance | m | 3.2 |
| shaft diameter | m | 0.6 |
| tank volume | $m^3$ | 402.1 |
| baffle number | | 6 |
| baffle width | m | 1.0 |
| baffle height | m | 7.75 |
| baffle location | m × m | 0.25 × 0.464 |

Two blade widths ($W_b/T=0.125$ ("slim blade") and 0.0625 ("fat blade") and three pitch angles 27°, 30° and 33° were varied for the proposed impeller to examine its performance and to check that the rules to form new impeller were universal for different conditions.

In Table II there is shown the effect of blade width on performance for the new impeller.

TABLE II

| Effect of blade width on performance | | | | | | | | | |
|---|---|---|---|---|---|---|---|---|---|
| case | $W_b/T$ | D/T | α ° | P kW | $N_p$ | Nq | $\eta_e$ | $\lambda_p$ | $m_p$ kg/s/(kW) |
| slim blade | 0.125 | 0.4 | 30 | 13.89 | 0.332 | 0.616 | 1.856 | 0.889 | 725.0 |
| fat blade | 0.0625 | 0.4 | 30 | 11.33 | 0.271 | 0.557 | 2.059 | 0.861 | 804.2 |

wherein $W_b$ is the width of the blade

T is tank diameter

D is impeller diameter $\alpha=\alpha_2+\alpha_3$ is the pitch angle (see FIG. 5)

P is the power $N_p$ is the power number $N_q$ is the pumping number $\eta_e$ is pumping effectiveness $\lambda_p$ is pumping efficiency $m_p$ is pumping mass flow rate per unit of power consumption Table II shows that the impeller according to invention has excellent performance characteristics.

In Table III there is shown volume fraction over the reactor volume at different turbulent viscosity (kg/ms) ranges for slim and fat blade impellers.

TABLE III

| case | $W_b/T$ | D/T | α | $\mu_t < 10$ (kg/ms) | $10 >= \mu_t < 20$ | $20 >= \mu_t < 30$ | $\mu_t >= 30$ |
|---|---|---|---|---|---|---|---|
| slim blade | 0.0625 | 0.4 | 30 | 0.632 | 0.249 | 0.090 | 0.029 |
| fat blade | 0.125 | 0.4 | 30 | 0.567 | 0.276 | 0.107 | 0.051 |

Table III: Volume fraction over the reactor volume at different turbulent viscosity (kg/ms) ranges for slim and fat blade impellers Table III shows a volume fraction over the reactor bulk volume at different turbulent viscosity ranges for the slim and fat blade impellers. It is seen that the impellers according to invention provide very low turbulent viscosity in most volume of reactor. For example, for slim blade impeller, the turbulent viscosity is below 10 kg/ms in 63% volume of the reactor, while for fat blade impeller, about 57% reactor volume has the turbulent viscosity below 10 kg/ms. There exists a very small volume with turbulent viscosity between 20 and 30 kg/ms. This indicates that the new impellers create very low shear and provide reasonable turbulent behavior which is required in many metallurgical applications.

Figure 8:
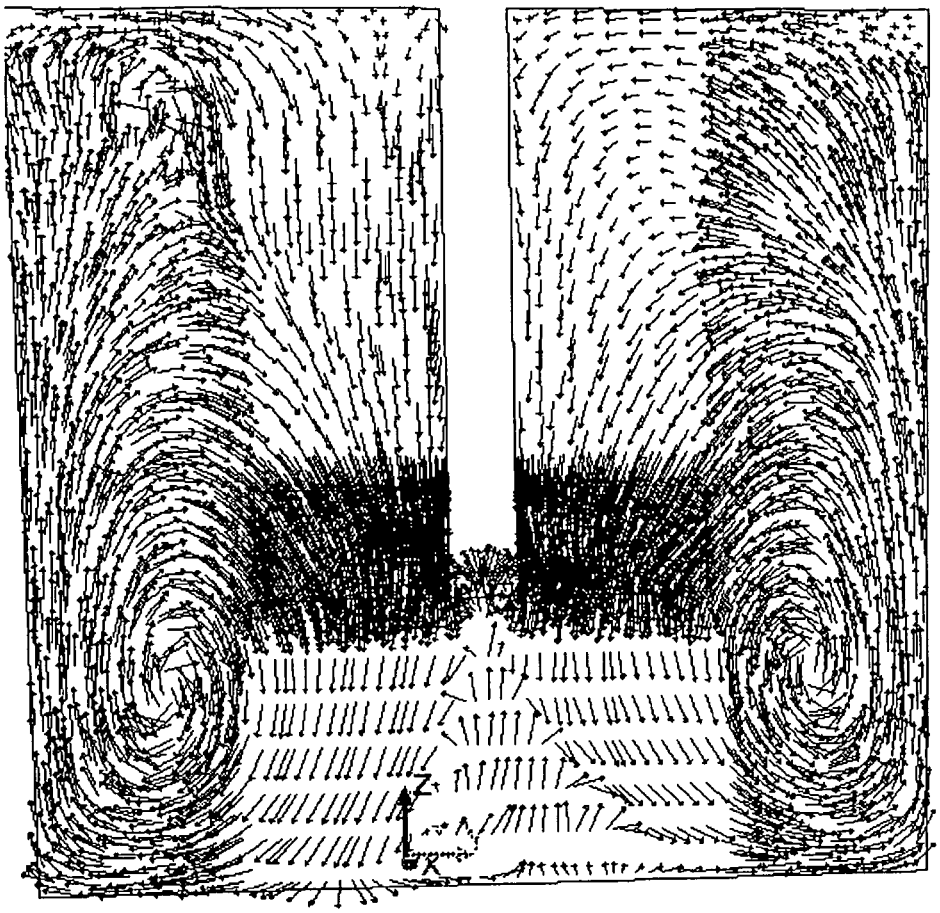
FIG. 8 shows the flow pattern in a reactor with the axial flow impeller of the invention.

In FIG. 8 there is shown a velocity vector plot for the new impeller. It is seen that the new impeller has an improved mixing performance because the axial flow is obviously enhanced relative to the radial and tangential velocity components. The recirculation zone becomes substantially large indicating that the new impeller is efficient.

It is shown that the invented impeller provides strong axial flow. Detailed study reveals that the invented impeller can achieve higher pumping efficiency and stronger axial flow with smaller power consumption and lower shear, compared to those by other applied axial impellers.

In the performance study it has been shown that the present invented impeller has the following advantages:

1) it is easy to fabricate;
2) it is easy to scale up and scale down according to the rules developed;
3) it consumes less power, and thus it reduces the operational cost;
4) it provides very high pumping capacity and pumping efficiency;
5) its performance is not sensitive to the blade width;
6) the pressure on its blade surface is uniformly distributed;
7) it provides a favorable flow pattern for mixing with low shear on the impeller surface and efficient pumping, and it creates very strong axial flow compared to radial and tangential flow.

While the present inventions have been described in connection with a number of exemplary embodiments, and implementations, the present inventions are not so limited, but rather cover various modifications, and equivalent arrangements, which fall within the purview of prospective claims.

The invention claimed is:

1. A blade connectable to a central hub of an axial flow impeller, the blade being formed from substantially plate-type material and having a leading edge, a trailing edge, a tip, a root attachable to the central hub of the impeller, a first fold extending along the blade in a straight first direction and dividing the blade into a first profile portion located adjacent to the leading edge and a second profile portion, the first and the second profile portions meeting at the first fold such that the first profile portion is angled at a first angle ($\alpha_1$) downwardly from the second profile portion, a second fold extending along the blade in a straight second direction which is different from said first direction and located apart from the first fold and dividing the blade further into a third profile portion located adjacent to the trailing edge, said second and third profile portions meeting at said second fold such that the third profile portion is angled at a second angle ($\alpha_2$) downwardly from the second profile portion, the second profile portion being angled at a third angle ($\alpha_3$) in relation to horizontal plane, and, in plan view, the blade has the general form of an enveloping rectangle ($R \times W_b$) with tapering cut-outs at at least root-side corners of the rectangle, said rectangle having a length R which is the lengthwise dimension from the axis of rotation of the impeller to the tip of the blade, and a width $W_b$ which is the widthwise dimension of the blade perpendicularly to the lengthwise direction, the enveloping rectangle having inner corners adjacent to the root and outer corners adjacent to the tip, characterized in that the contour of the blade is defined by the proportional dimensions of the tapering cut-outs from the enveloping rectangle, the cutouts comprising a first cut-out which is adjacent the root and a first inner corner of the rectangle at the side of the leading edge, the first cut-out having a form of a right triangle with the lengthwise cathetus having a dimension A=0.2R, a widthwise cathetus having a dimension $B=0.2W_b$, and a hypotenuse which forms a first cut-out edge of the blade extending from the root to the leading edge, a second cut-out which is adjacent to the root and a second inner corner of the rectangle at the side of the trailing edge, the second cut-out having a form of a right triangle with the lengthwise cathetus having a dimension C=0.2R, a widthwise cathetus having a dimension $D=0.2W_b$, and a hypotenuse which forms a second cut-out edge of the blade extending from the root to the trailing edge, a third cut-out which is adjacent to the tip and a first outer corner of the rectangle at the side of the leading edge, the third cut-out having a form of a right triangle with the lengthwise cathetus having a dimension E=0.5R, a widthwise cathetus having a dimension F=(0.1 to 0.2)R and a hypotenuse which forms a third cut-out edge of the blade extending from the leading edge to the tip, the third cut-out edge connecting to the tip with a rounding having a radius of curvature $G=0.2W_b$, and a fourth cut-out which is adjacent to the tip and a second outer corner of the rectangle at the side of the trailing edge, the fourth cut-out having a form of a right triangle with the lengthwise cathetus having a dimension H=0.25R, a widthwise cathetus having a dimension I=0.1R and a hypotenuse which forms a fourth cutout edge of the blade extending from the trailing edge to the tip, the fourth cut-out edge connecting to the tip with a rounding having a radius of curvature $G=0.2W_b$;

that the first fold intersects the lengthwise side of the enveloping rectangle at the meeting point of the first cut-out edge and the leading edge at the distance A=0.2R from the first inner corner, and the first fold intersects the widthwise side of the enveloping rectangle adjacent to the tip at the distance J=0.4R from the third corner;

that the second fold intersects the widthwise side of the enveloping rectangle adjacent to the root at a widthwise distance $K=0.1W_b$ from the first corner, and the second fold intersects the side of the enveloping rectangle adjacent to the tip at a widthwise distance I=0.1R from the fourth corner;

and that the first angle ($\alpha_1=6°\pm1°$, the second angle $\alpha_2=8°\pm1°$ and the third angle $\alpha_3=19°$ to 25°.

2. The blade according to claim 1 connected to the central hub of an axial flow impeller, the central hub connectable to a rotatable shaft having a central axis of rotation, the axial flow impeller having a second blade according to claim 1, the blade and the second blade being attached to the central hub and extending radially outwardly from the hub.

3. The blade according to claim 2, where the impeller comprises at least three equally-spaced said blades.

4. The axial flow impeller according to claim 2, characterized in that the impeller comprises four or more equally-spaced said blades.

* * * * *